US006839995B2

(12) United States Patent
Chiu

(10) Patent No.: US 6,839,995 B2
(45) Date of Patent: Jan. 11, 2005

(54) ALBUM PAGE AND FABRICATION

(76) Inventor: Alan Chun Ming Chiu, 3 Fung Sau Road D.D. 252, Lot 287 Sai Kung, Kowloon (HK)

( * ) Notice: Subject to any disclaimer, the term of this patent is extended or adjusted under 35 U.S.C. 154(b) by 31 days.

(21) Appl. No.: 10/161,172

(22) Filed: Jun. 4, 2002

(65) Prior Publication Data

US 2003/0221346 A1 Dec. 4, 2003

(51) Int. Cl.[7] ..... G09F 19/00
(52) U.S. Cl. ..... 40/530; 40/536; 40/773
(58) Field of Search ..... 40/360, 530, 533, 40/534, 536, 773, 788; 281/38; 402/79

(56) References Cited

U.S. PATENT DOCUMENTS

| | | | | | |
|---|---|---|---|---|---|
| 2,095,437 | A | * | 10/1937 | Fox | 40/638 |
| 3,735,516 | A | * | 5/1973 | Wenstrom | 40/536 |
| 3,847,325 | A | | 11/1974 | Nasalski et al. | |
| 3,921,322 | A | * | 11/1975 | Sharp | 40/405 |
| 4,023,292 | A | * | 5/1977 | Shibata et al. | 40/773 |
| 4,057,923 | A | | 11/1977 | Chase | |
| 4,140,565 | A | | 2/1979 | Parker et al. | |
| 4,145,830 | A | * | 3/1979 | Desmarais et al. | 40/404 |
| 4,356,649 | A | | 11/1982 | Diamond et al. | |
| 4,424,637 | A | * | 1/1984 | Leahy | 40/773 |
| 4,809,451 | A | | 3/1989 | Suzuki | |
| 4,921,747 | A | | 5/1990 | Studley | |
| 5,301,445 | A | * | 4/1994 | Hoffmeister | 40/537 |
| 5,437,428 | A | | 8/1995 | Mirza | |
| 5,498,455 | A | | 3/1996 | Roberts | |
| 5,533,288 | A | | 7/1996 | Lambert | |
| 5,543,190 | A | | 8/1996 | Johnson et al. | |
| 6,056,494 | A | * | 5/2000 | Fong et al. | 412/37 |
| 6,253,475 | B1 | | 7/2001 | Ruebens | |

* cited by examiner

*Primary Examiner*—Brian K. Green
(74) *Attorney, Agent, or Firm*—William W. Haefliger

(57) ABSTRACT

An album page adapted for inclusion in an album for holding an applied display sheet or sheets, comprising in combination narrow flat elongated spacers extending lengthwise on the page, in spaced apart relation, and to project from a plane defined by the page; and a retainer or retainers on the page and located between the spacers, to retain applied sheet or sheets, protectively between the spacers.

21 Claims, 4 Drawing Sheets

ALBUM PAGE AND FABRICATION

BACKGROUND OF THE INVENTION

This invention relates generally to improvements in albums, as for example photograph albums, and more particularly to improvements in pages of albums that facilitate mounting and/or display of photographs and/or memoranda elements.

There is continual need for improvements in such albums and/or album pages, to assist, or enhance, ease of their usage. For example there is need for ways to easily and rapidly mount, photographs on album pages, and to enable removal of mounted photographs without damage either to album pages or to the photographs during their removal. There is also need for display or mounting of memoranda and/or caption elements on such improved album pages.

SUMMARY OF THE INVENTION

It is a major object of the invention to provide improved apparatus meeting the above needs.

The improved album page configured in accordance with the invention for holding an applied display sheet or sheets such as photographs, includes:

a) narrow flat elongated spacers extending lengthwise on the page, in spaced apart relation, and to project from a plane defined by the page, b) and a retainer or retainers on the page and located between the spacers, to retain an applied sheet or sheets, protectively between the spacers.

As will be seen, a first such spacer typically comprises a first part of the album page which itself defines an elongated Z-fold. Such a Z-fold advantageously has upper and lower portions connected by an angled flap which may be bonded to one or both of the upper and lower Z-fold portions. A second such spacer typically comprises a second part of the album page which itself defines an overlying fold and a concealed intermediate fold which projects between the overlying fold and a portion of the sheet underlying the overlying and intermediate folds.

Another object is to provide such spacers to extend in elongated generally parallel relation, vertically of and along the album page, and in transversely spaced relation, so that photographs may be protectively positioned between the spacers. Successive, closed album pages are then held spaced apart by the spacers, with photos protectively positioned in pockets formed between such pages, so that the photographs are not crushed by the pages upon closing of the album.

Yet another object of the invention is to provide retainers for the photographs, or other display sheets, in the form of adhesive material located on the album page between the spacers. A peel-off cover strip or strips may then be provided to protectively cover the adhesive until a photograph or other display sheet is to be applied, i.e. mounted in position. That cover strip may advantageously have a free end portion offset from the adhesive to be grasped for enabling rapid and easy peel-of of the cover strip from the adhesive. Multiple such adhesive zones and cover strips may be provided on an album page, between the elongated spacers, so that total thickness of the adhesive and applied photographs does not exceed the heights of the spacers projecting from the album page, to enable protection upon album closure, as referred to.

Another object is to provide caption strips applicable to adhesive zones between the spacers, to enable caption positioning in selected juxtaposition to the mounted photographs.

A yet further object is to provide a page extension projecting at a side of a spacer in a direction away from both of said spacers, to define a memo surface.

In the above, the page itself may advantageously consist of heavy paper such as Kraft paper or the like.

These and other objects and advantages of the invention, as well as the details of an illustrative embodiment, will be more fully understood from the following specification and drawings, in which:

DRAWING DESCRIPTION

DETAILED DESCRIPTION

Figure 1:
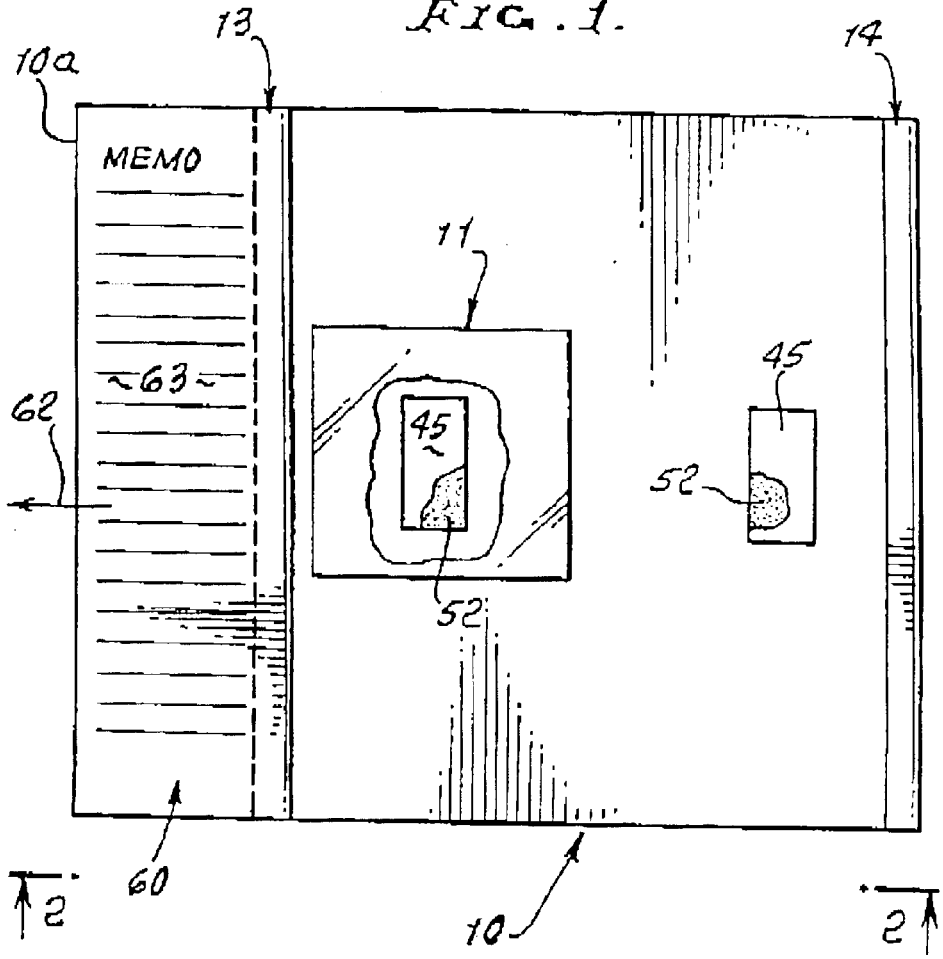
FIG. 1 is a frontal view of an album page incorporating the invention.
Figure 2:
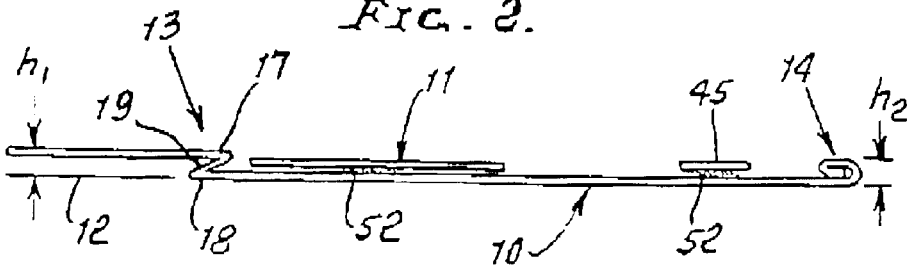
FIG. 2 is an end view of the FIG. 1 page, and taken on lines 2—2 of FIG. 1.

In FIGS. 1 and 2, an album page 10 is adapted for inclusion in an album, and the page is configured for holding an applied display sheet. On such sheet is shown at 11, and may comprise a photograph, protectively mounted on the page.

Narrow, flat elongated spacers are provided to extend lengthwise on the page, in spaced apart relation, and to project from a plane 12 (see FIG. 2) defined by the main extent of the page. Two such spacers 13 and 14 are shown, extending lengthwise longitudinally on and along the page, and are transversely spaced apart. The spacers project outwardly from the plane 12 to an extent or extents that the photograph 11 is protectively located between the spacers, as for example is shown in FIG. 2. The overall height of spacer 13 above plane 12 is indicated at $h_1$, and the overall height of spacer 14 is above plane 11 is indicated at $h_2$. Dimensions $h_1$ and $h_2$ are typically equal or substantially equal.

Figure 8:
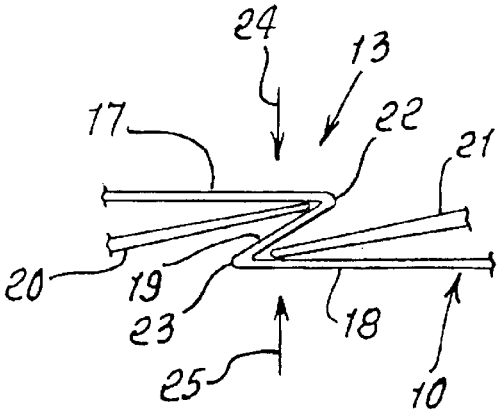
FIGS. 8 and 9 are sections showing progressive Z-folding.
Figure 9:
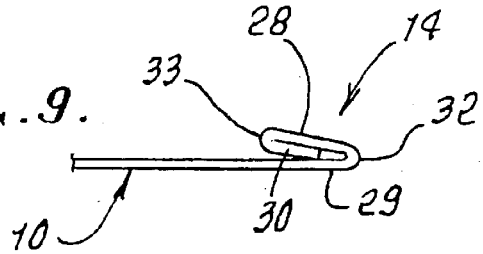

Of advantage to reduce cost of fabrication of the spacers is their inclusion as parts of the page itself. Thus, spacer 13 advantageously comprises a first part of the page 10, and defines a Z-fold. That Z-fold has upper and lower flat portions 17 and 18 connected by an intermediate angled flap 19, and such that flap 19 is sandwiched between 17 and 18. FIG. 8 shows steps in fabrication wherein pushers 20 and 21 are advanced to push the page 10 and cause folding at edges 22 and 23, and formation of flap 19, followed by retraction of the pushers and application of normal forces 24 and 25 to compress the flap 19 between Z-fold flat portions 17 and 18, to the compressed condition seen in FIG. 2. Glue or adhesive is typically applied, as by transfer from the surfaces of the pushers 20 and 21, whereby the Z-fold is held or bonded in compressed or compacted condition. The pushers 20 and 21 may comprise rollers, which travel lengthwise of the Z-fold, to progressively lengthwise form it. This establishes the height $h_1$ of the Z-fold above plane 12.

Figure 3:
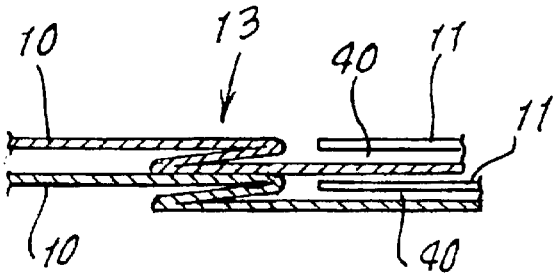
FIG. 3 is a fragmentary, enlarged view showing a Z-fold as used in FIGS. 1 and 2.
Figure 4:
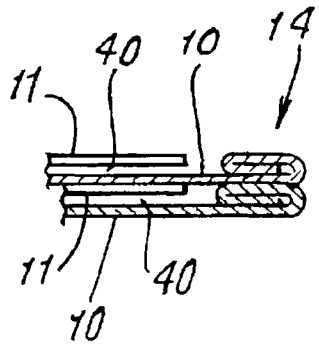
FIG. 4 is a fragmentary enlarged view showing another page fold, as used in FIGS. 1 and 2.
Figure 10:
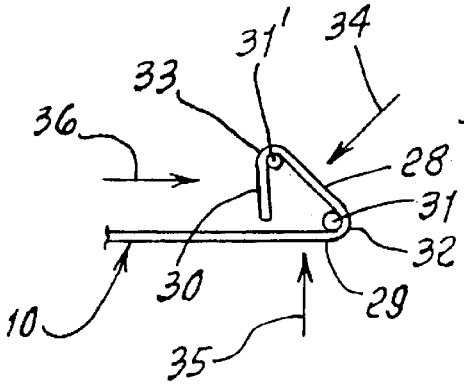
FIGS. 10 and 11 are sections showing progressive under-folding.
Figure 11:
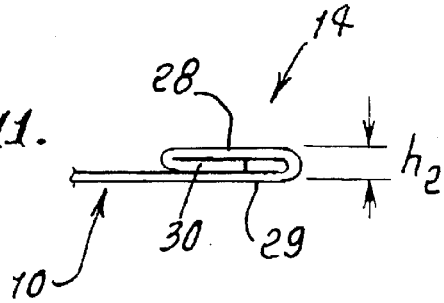

The second spacer 14 typically comprises a second part of the page 10, and defines an overlying portion or fold 28, a lower portion 29, and an intermediate fold or flap 30. FIG. 10 shows an intermediate step in formation of 28, 29 and 30, with fold 28 formed on an anvil rod 31, to form bend 32; and fold 30 formed over anvil rod 31', to form bend 33. After withdrawal of rods 31 and 32, forces are applied as indicated by arrows 34, 35 and 36, to tuck flap 30 protectively and between 28 and 29, in sandwiched relation, and to compress the pack to the condition seen in FIG. 11. Adhesive may be applied between 28 and 30, and between 29 and 30, to form a permanent spacer 14 of height $h_2$ above plane 11. Glue may be applied between 30 and layers 28 and 29. Since the page is of a predetermined thickness, and since each of the spacers includes three stacked portions of the page, the heights $h_1$ and $h_2$ are equal or approximately equal, and this is of importance when the album pages are closed together in stacked relation to provide an album of corresponding overall thickness, the photographs applied to or mounted to the pages, and protectively retained in "pockets" as seen at 40 in FIGS. 3 and 4.

Figure 5:
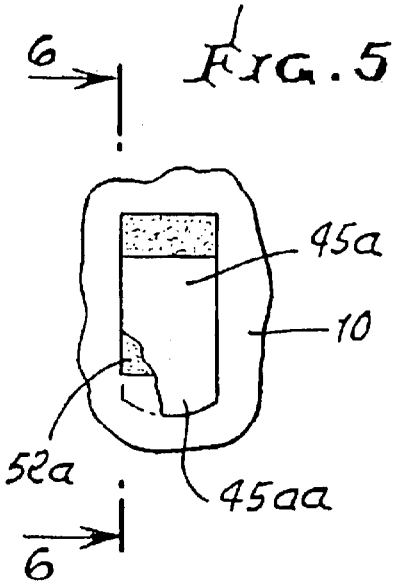
FIG. 5 is a frontal view of a protected retainer.
Figure 6:
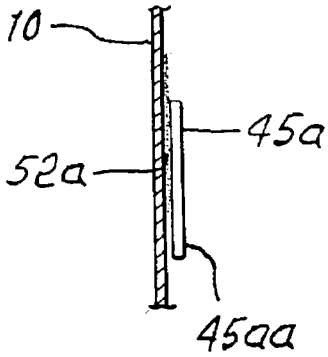
FIG. 6 is an edge view taken on lines 6—6 of FIG. 5.

A further feature of the invention is the provision of a retainer or retainers on the page and located between such spacers, to retain the applied sheet or sheets, protectively between the spacers. In FIG. 1, protective cover strips 45 are applied to retainer material such as adhesive layers 52 applied on the page, at locations to hold a display sheet 11 as for example a photograph, as referred to above. Sheet 11 is locally broken away to show 45, and 45 is broken away to show 52. The cover strip 45 is typically stripped off the adhesive 52, to expose the latter, for press-on application of the display sheet at the time of mounting, between the spacers 13 and 14. Such mounting is seen in FIG. 2. FIGS. 5 and 6 show a modified cover strip 45*a* with an end portion 45*aa* offset from the adhesive layer 52*a* at one end thereof. This enables easy grasping of the free end portion 45*aa* for enabling peel-off from the adhesive layer.

FIG. 1 also shows the album page 10 having a sideward extension 60 projecting at one transverse side of spacer 13, and in a width direction 62 away from both spacers 13 and 14, to define a MEMO surface 63. Surface 63 is located between edge 10*a* of the page 10, and spacer 13, and may have uniform width, along its length, as shown.

Figure 7:
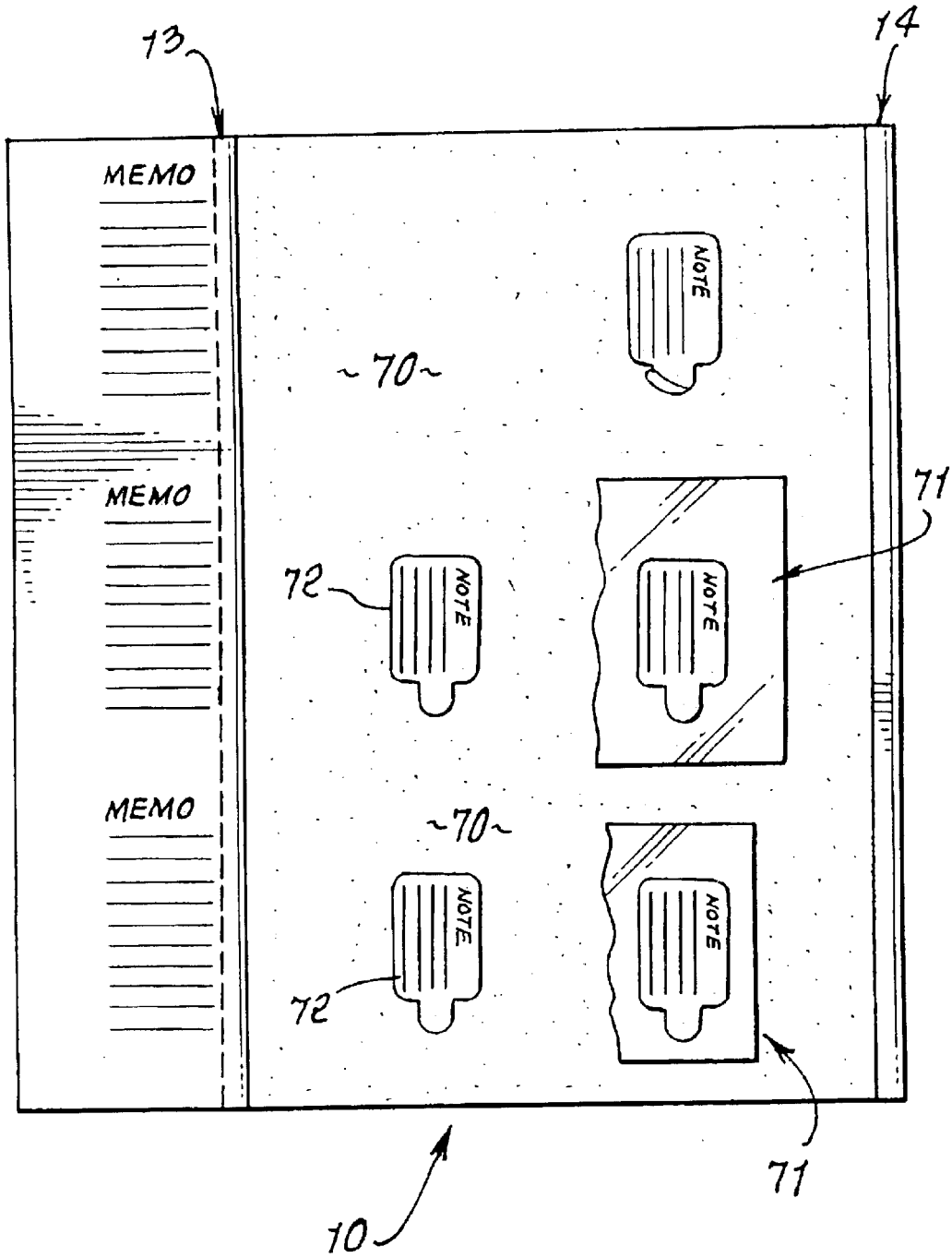
FIG. 7 is a view like FIG. 1, showing provision of caption notes applied to an album page.

FIG. 7 is like FIG. 1, except that self-adhesive glue is located or applied over a major extent of the page surface as at 70 between the spacers 13 and 14. This facilitates press-on mounting of photograph 71 at a large number of selected positions on the page. Caption note strips 72 are applicable to surface 70, in many different positions. Certain caption strips may be covered by applied photographs. Indicia on 72 identifies or correlates to 71.

I claim:

1. A first album page adapted for inclusion in an album for holding at least one applied display sheet, comprising in combination a) narrow flat elongated first and second spacers extending lengthwise on the page, in spaced apart relation, and projecting from a plane defined by the page, b) and at least one retainer on the page and located between said spacers, to retain said at least one applied sheet, protectively between the spacers, c) and wherein said first spacer comprises a first part of the page defining a Z-fold, d) and wherein said second spacer comprises a second part of the page defining an overlying fold and a concealed intermediate fold.

2. The album page of claim 1 wherein the Z-fold has upper and lower portions connected by an angled flap.

3. The album page of claim 2 wherein the flap is bonded to said upper and lower Z-fold portions.

4. The album page of claim 1 wherein said second spacer intermediate fold projects between said overlying fold and a portion of the page underlying said overlying and intermediate folds.

5. The album page of claim 4 wherein the intermediate fold is bonded to said overlying fold and said underlying portion of the page.

6. The album page of claim 1 wherein the at least one retainer comprises an adhesive, and a peel-off cover strip overlying said adhesive.

7. The album page of claim 6 wherein said cover strip has an end-portion offset from said adhesive, to be grasped for enabling peel-off of the cover strip from the adhesive.

8. The album page of claim 1 wherein the at least one retainer include a plurality of retainers, each comprising an adhesive and a peel-off cover strip overlying said adhesive.

9. The album page of claim 8 wherein a cover strip has an end portion offset from said adhesive to be grasped for enabling peel-off of the cover strip from the adhesive.

10. The album page of claim 1 including said at least one applied display sheet adherent to at least one retainer and located at the level of and between said spacers.

11. The album page of claim 10 wherein said at least one display sheet comprises a photograph or photographs.

12. The album page of claim 10 including another album page held spaced from said first album page by said spacers, with said at least one display sheet protectively located between said pages.

13. The album page of claim 12 wherein said at least one display sheet comprises a photograph or photographs.

14. The album page of claim 10 including a caption note strip applied to said page in juxtaposed relation to said at least one display sheet.

15. The album page of claim 1 wherein said page has an extension projecting at a side of one spacer in a direction away from both of said spacers, to define a memo surface.

16. The album page of claim 1 wherein said page consists of heavy paper.

17. The album page of claim 1 wherein the at least one applied sheet is a reduced size layer having an exposed visual memo surface.

18. The album page of claim 17 wherein said reduced size layer includes a plurality of reduced size layers respectively adherent to multiple adhesives defined by the at least one retainer.

19. The album page of claim 1 wherein said at least one retainer includes at least one retainer that comprises an adhesive located between said spacers, and to which the at least one applied display sheet is adherent, and at least one caption layer adherent to said adhesive, proximate said display sheet.

20. The album page of claim 19 wherein said at least one display sheet is a photograph or photographs.

21. A first album page adapted for inclusion in an album for holding at least one applied display sheet, comprising in combination a) narrow flat elongated spacers extending lengthwise on the page, in spaced apart relation, and projecting from a plane defined by the page, b) and a retainer or retainers on the page and located between said spacers, to retain said at least one applied sheet, protectively between the spacers, c) there being an additional album page held facewise spaced from said first page by said spacers, with said at least one display sheet remaining protectively located edgewise between said spacers, the dimensions of said spacers toward said additional page exceeding the thickness of said at least one display sheet, d) one of said spacers having a Z-fold configuration, and another of said spacers including a folded configuration.

* * * * *